United States Patent [19]

Barnes

[11] 3,935,704

[45] Feb. 3, 1976

[54] FAN PROPULSOR OIL ESCAPEMENT MEANS

[75] Inventor: Philip E. Barnes, West Hartford, Conn.

[73] Assignee: United Technologies Corporation, Hartford, Conn.

[22] Filed: Sept. 12, 1974

[21] Appl. No.: 505,402

[52] U.S. Cl. ..... 60/226 R; 60/39.08; 415/130; 415/168; 416/90 R; 416/174

[51] Int. Cl.² ..... F02C 3/06; F02K 3/06

[58] Field of Search ..... 415/129, 130, 168; 416/90, 416/174; 60/226 R, 226 A, 39.08

[56] References Cited

UNITED STATES PATENTS

| | | | |
|---|---|---|---|
| 2,230,708 | 2/1941 | Wahl | 416/174 |
| 3,866,415 | 2/1975 | Ciokajilo | 60/226 R |

*Primary Examiner*—William L. Freeh
*Assistant Examiner*—Robert E. Garrett
*Attorney, Agent, or Firm*—John D. Del Ponti

[57] ABSTRACT

This invention cures the problem attendant the ingestion of oil in the engine of a fan-turbine engine combustion propulsor should oil leak from the fan blade seal by capturing and judiciously venting the leakage.

6 Claims, 2 Drawing Figures

FAN PROPULSOR OIL ESCAPEMENT MEANS

BACKGROUND OF THE INVENTION

This invention relates to fan propulsors of the type where the fan (either fixed or variable) is enclosed in an engine bypass duct and is closely coupled to a gas turbine engine and particularly to means for preventing blade oil leakage from migrating to the inlet of the engine.

It is known that oil ingested in the engine not only may be the cause of loss of engine efficiency with possible deterioration of combustion but also oil in the compressor airstream could migrate into the bleed air system with possible carry over in the air conditioning system where it could contaminate the aircraft cabin and the like. This invention is particularly concerned with a ducted fan propulsor where the engine is closely coupled to the fan, since such an environment increases the potential of this occurrence. While in the past the leakage of oil directly in the airstream was acceptable, it is intolerable for a ducted fan application. Thus, a single seal for the fan blade seal would by itself be unacceptable.

This invention obviates the problem noted above by providing capturing and venting means of oil leaking from the blade seal, without adding to the blade/hub complexity by using double sealing techniques or redundant devices or the like.

SUMMARY OF THE INVENTION

The prime object is to provide improved oil entrapment and escapement means for a ducted fan propulsor to avoid migration of leakage oil in the engine inlet.

A further object of the invention is to provide for a ducted fan propulsor an annular recess or gutter on the blade shank in proximity to and surrounding the blade retaining recess in the hub and a drilled passage or tube communicating therewith and extending generally longitudinally in the blade or along the blade to route the leaked oil to a point where it is not possible for the oil to be ingested into the engine.

A further object of this invention is to provide oil leakage entrapment and escapement means for a ducted fan propulsor which is characterized as being simple, easy to fabricate, install and relatively inexpensive.

The foregoing and other objects, features and advantages of the present invention will become more apparent in the light of the following detailed description of the preferred embodiment thereof as illustrated in the accompanying drawing.

DESCRIPTION OF THE PREFERRED EMBODIMENT

While this invention is described herein as being utilized on a ducted-fan of the type that is being developed by the Hamilton Standard Division of United Aircraft Corporation, and generally known as a Q-Fan™ propulsor, it is to be understood that the concept as will be understood by those in the art is not limited to this particular embodiment.

Figure 1:
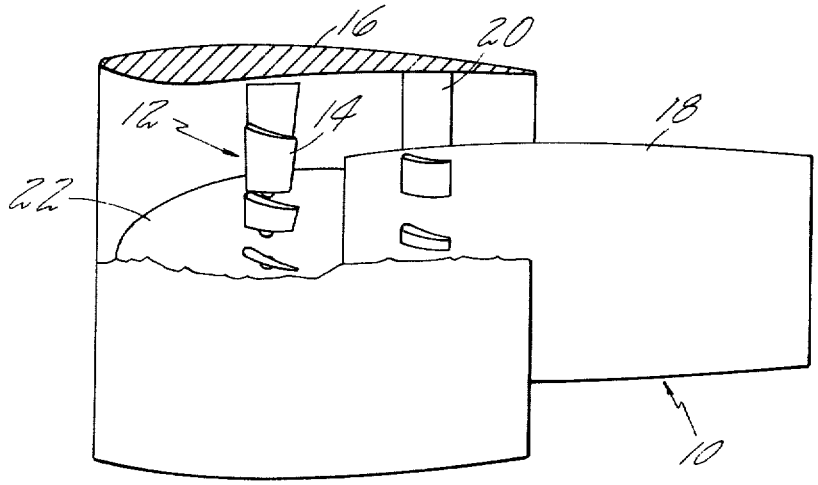
FIG. 1 is a schematic view in elevation showing a typical ducted fan propulsor.

Reference is now made to FIG. 1 which schematically illustrates a ducted fan propulsor having an engine 10, shown in blank which may be any suitable gas turbine engine driving the fan 12 comprising a plurality of fan blades 14 which may be of the fixed or variable pitch type, which is rotatable in bypass duct 16 supported to engine casing 18 by vanes 20. A spinner 22 may be incorporated as shown. A suitable ducted fan propulsor is described in U.S. Pat. No. 3,747,343, dated July 24, 1973 granted to George Rosen and assigned to the same assignee and is incorporated herein by reference.

Suffice it to say that the inlet of the engine 10 is in close proximity to the blades 14 and a portion of the air leaving the blades is ingested by the engine while a portion is bypassed and exited through the bypass duct. In the event of a reversible fan, the air obviously is admitted through the rear end of the duct and a portion is still directed to the engine inlet while the remainder is discharged through the bypass duct inlet. It is apparent that without any precaution, oil leakage from the fan structure would, due to centrifugal forces, be forced radially outward and be carried by the airstream into the inlet of the engine. This problem is obviated by this invention which is best understood by referring to FIg. 2.

Figure 2:
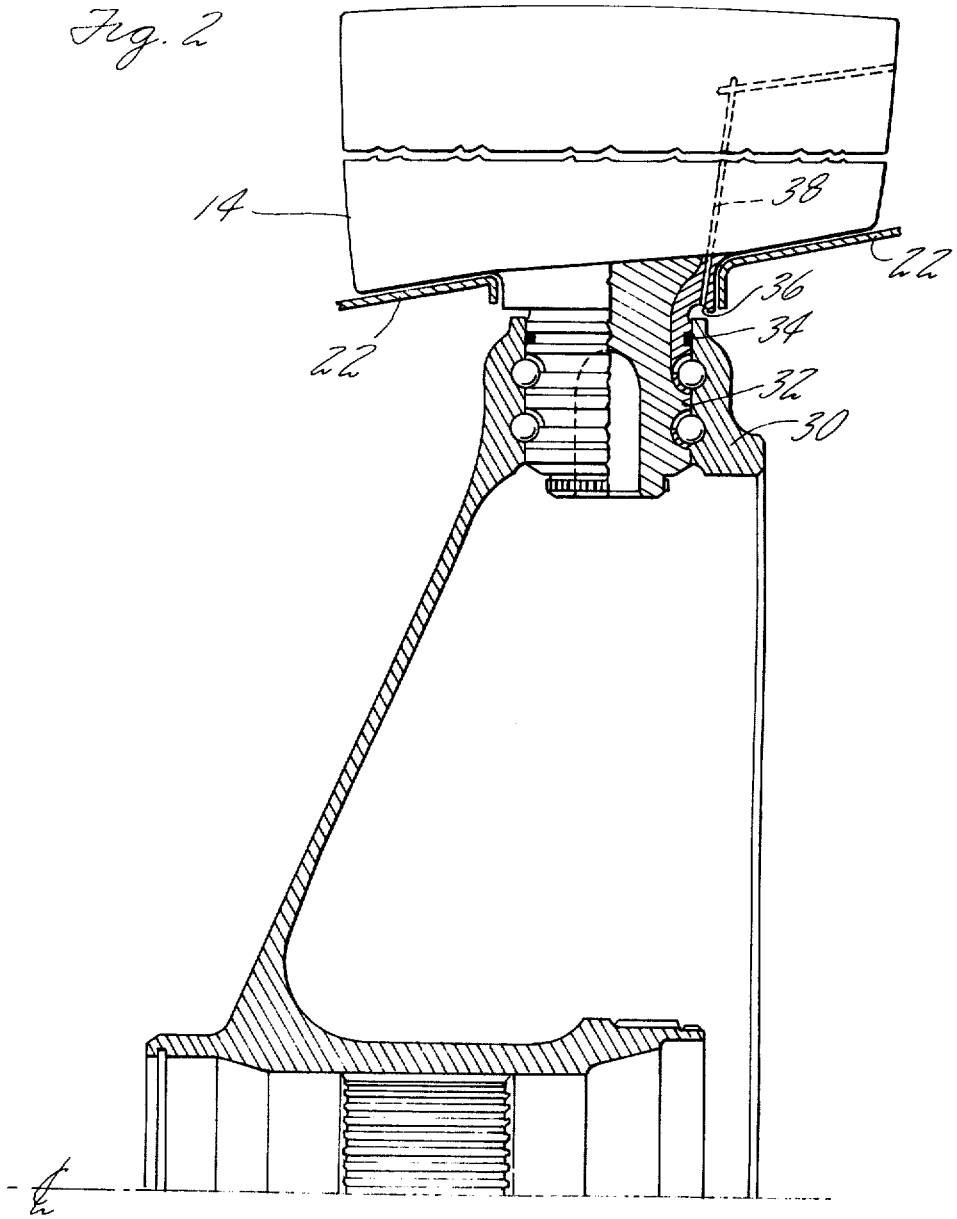
FIG. 2 is a partial view partly in section and partly in elevation showing the details of this invention.

As can be seen in FIG. 2 the blade 14 is supported in barrel 30 and is suitably retained therein by well known means. The root or shank of the blade is supported in the recess 32 and a typical "o" seal 34 is mounted to bear against the inner wall of the recess 32 and serves to prevent oil which is usually flooded within the barrel from escaping. Owing to faulty seal or the malfunctioning thereof, the potential of the escapement of oil is always present.

The obvious solution to the problem is to incorporate a second or double seal or utilize the spinner which is in close proximity to avoid the escaped oil from migrating to the airstream that feeds the engine.

This invention avoids the complexities of the methods suggested immediately above by providing a gutter, which is an annular recess 36 formed on the shank of the blade or on a built up portion formed on the shank as shown. A drilled passage 38 extends longitudinally through the blade and terminates at a point where it vents the leaking oil in the airstream portion that does not ingest into the engine; namely, outboard of the engine inlet splitter defined by the casing surrounding the inlet. Obviously, a tube attached to the blade, internally or externally may serve the same purpose of routing the oil.

What has been shown by this invention is oil leakage entrapment and escapement means that eliminates the adverse effect attendant potential blade seal leakage without the use of double sealing or other redundant devices.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. In a ducted fan propulsor having a plurality of fan blades disposed upstream of a gas turbine engine, each of said fan blades having an inner section including a shank in proximity to the inlet of said gas turbine engine and an outer section in proximity to an engine bypass duct, said shank being mounted in a recess in a hub, an improvement for capturing oil escaping from said hub recess which comprises an annularly grooved portion on said blade inner section spaced longitudinally outwardly from said hub recess with said annular groove overlying said hub recess and passage means extending from said groove to said blade outer portion for venting oil collected in said annular groove to said bypass duct.

2. In a ducted fan propulsor having a plurality of fan blades disposed upstream of a gas turbine engine, each of said fan blades having an inner portion including a shank in proximity to the inlet of said gas turbine engine and an outer portion in proximity to an engine bypass duct, said shank being mounted in a recess in a hub, an improvement for capturing oil escaping from said hub recess which comprises an enlarged diameter portion on said shank spaced longitudinally outwardly from said hub recess and having an annular recess therein overlying said hub recess and passage means extending from said annular recess to said blade outer portion for venting oil collected in said annular recess to said bypass duct.

3. Means for capturing oil as claimed in claim 2 including ball bearings supporting said blade shank for blade angle movement.

4. Means for capturing oil as claimed in claim 3 including sealing means adjacent said hub recess outboard relative to said ball bearings.

5. Means as claimed in claim 2 wherein said passage means is a passageway formed generally longitudinally in said blade.

6. Means as claimed in claim 2 wherein said passage means is a tube.

* * * * *